US006709339B1

(12) United States Patent
Hargabus

(10) Patent No.: US 6,709,339 B1
(45) Date of Patent: Mar. 23, 2004

(54) QUICK EXCHANGE INFINITY MIRROR DISPLAY APPARATUS AND METHOD

(76) Inventor: Patrick A. Hargabus, 816 Locklear Ave., Sarasota, FL (US) 34237-8320

( * ) Notice: Subject to any disclaimer, the term of this patent is extended or adjusted under 35 U.S.C. 154(b) by 23 days.

(21) Appl. No.: 09/677,705

(22) Filed: Sep. 30, 2000

Related U.S. Application Data

(63) Continuation-in-part of application No. 09/375,894, filed on Aug. 17, 1999, now abandoned.

(51) Int. Cl.[7] ..... A63J 5/02
(52) U.S. Cl. ..... 472/63; 40/541
(58) Field of Search ..... 472/59, 63, 61; 40/541, 446, 452, 489, 582

(56) References Cited

U.S. PATENT DOCUMENTS 1,880,026 A * 9/1932 Singerman ..... 40/446 X
2,056,396 A 10/1936 Gorrie
5,787,618 A * 8/1998 Mullis ..... 40/219

* cited by examiner

*Primary Examiner*—Kien T. Nguyen

(74) *Attorney, Agent, or Firm*—Dorothy S. Morse

(57) ABSTRACT

An infinity mirror display apparatus, and a method for its manufacture, which allows a user to rapidly change out or add to a selection of objects used with mirrors able to cause an infinity mirror effect. The device comprises a housing having a stationary base member and an easily removable cover which together define an enclosed interior space, at least two mirrors positioned adjacent to the interior space with at least one of the mirrors being partially reflective, and at least one display object and one light source also being positioned within the interior space. The cover can be partially or totally removed from the stationary member for display object exchange. Also, the mirror through which an observer views the infinity mirror effect in a displayed object must be partially reflective. Housings can be wall-mounted wherein the infinity mirror effect can be viewed through a front cover and/or the sides of the mounted stationary member, or table-mounted wherein a full 360° viewing of the infinity mirror effect can be possible through the cover. Optionally, a variety of display object supports may be employed within the housing. Applications may include, but are not limited to, enhanced display of collections to which the owner frequently makes additions and the opportunity to display currently favored personal treasures or art objects and then to be able to easily and rapidly exchange them at any time for one or more newly favored treasures or art objects to create a different infinity mirror effect.

20 Claims, 7 Drawing Sheets

50
52
4
18
30B
82
54
56
82
20
10
16
12
82
30A
8
26
22

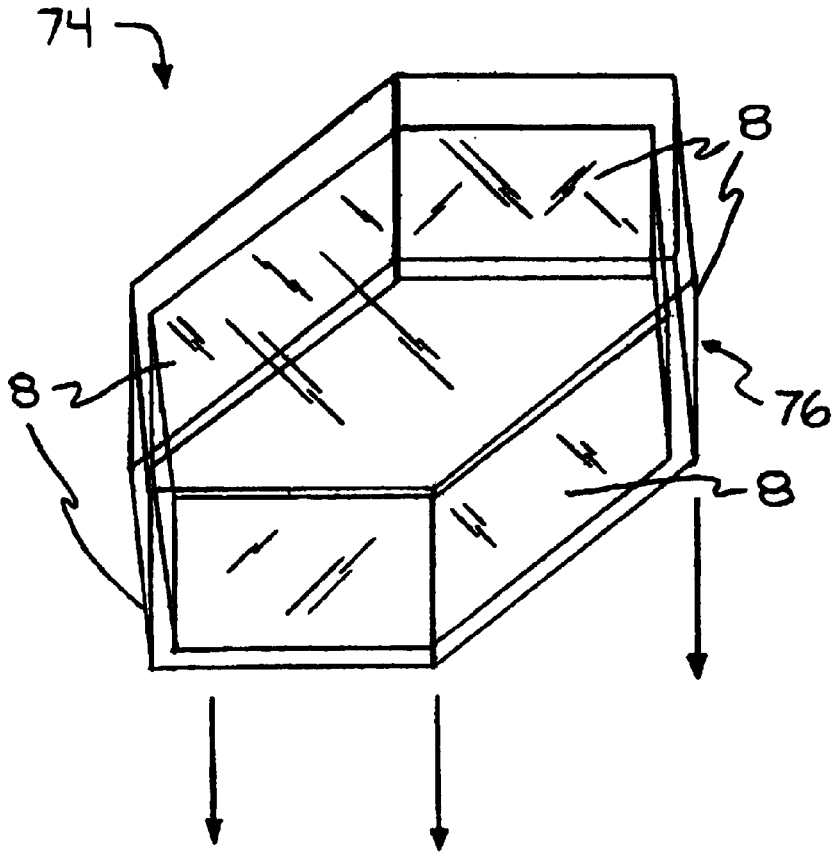
Fig. 9
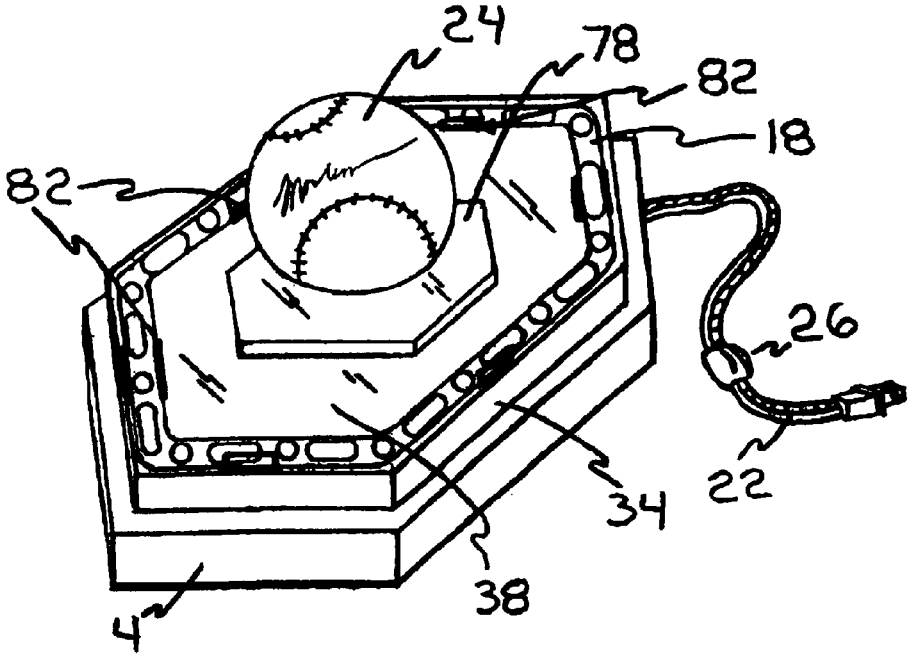

80
6
8
76
8
38
24
34
40
32
4
22
26

QUICK EXCHANGE INFINITY MIRROR DISPLAY APPARATUS AND METHOD

This is a continuation-in-part utility patent application based upon the invention disclosed in U.S. patent application Ser. No. 09/375,894 to the same inventor, filed Aug. 17, 1999, now abandoned, and benefit of the previous patent application is requested herein.

BACKGROUND

1. Field of Invention

This invention relates to devices for creating infinity mirror displays, specifically to an infinity mirror display apparatus, and a method for its manufacture, which allows a user to rapidly change out or add to a selection of display objects used with mirrors able to cause an infinity mirror effect. The device comprises a housing having a stationary base member and an easily removable cover which together define an enclosed interior space, at least two mirrors adjacent to the interior space in positions opposed to one another with at least one of the mirrors being partially reflective and providing one source of viewing the infinity display effect, at least one display object being positioned within the interior space between the mirrors, and one or more light sources also positioned within the interior space to provide illumination of the display object or objects. The cover can be partially or totally removed from its closed position against the stationary base member for display object exchange. Also, when additional mirrors are used, pleasing variations in the infinity display effect can be produced and viewed from any direction where the line of sight is directed through one of the partially reflective mirrors. It is also contemplated for the housings in different preferred embodiments to be wall-mounted wherein the infinity mirror effect can be viewed through a hinged or sliding front cover having a single panel and/or the sides of the mounted stationary base member, as well as through a hinged cover having two or more connected panels, or in the alternative for the housing to be table-mounted wherein a full 360° viewing of the infinity mirror effect is possible through a multiple-sided cover. Optionally, a variety of support surfaces and support devices may be employed within the housing for securely positioning a selection of display objects in different locations within the housing. Also, different types of light sources, including multiple light sources, are contemplated for use in illuminating the display objects. Applications may include, but are not limited to, infinity mirror display effect for any collection to which the owner is frequently making additions so that the members of the collection may be easily and readily added thereto, dust-free enhanced display of trophies and awards so that those newly received can be easily placed along side of those earlier received, enhanced display of autographed items such as baseballs so that new acquisitions can be promptly and easily added to those previously secured, and the opportunity for enhanced display of currently favored personal treasures or art objects with the opportunity at any time for their easy and rapid exchange for one or more newly favored treasures or art objects to create a different infinity mirror effect.

2. Description of Prior Art

The infinity mirror effect is a principle disclosed in U.S. Pat. No. 4,761,004 to Hargabus (1988) and various other patents. Through the use of a partially reflective mirror positioned between a viewer and a totally reflective mirror, and when the two mirrors are oriented approximately parallel to one another, illuminated objects placed between the two mirrors and viewed from any direction other than a straight-forward position will be observed to have multiple, spaced-apart reflections extending rearwardly therefrom. Differing effects can be created by placing one of the mirrors at an oblique angle relative to the other, and by adding more partially reflective mirrors. The infinity mirror display effect will be composed of multiple, alternating front and back, spaced-apart reflections extending rearwardly from each display object used with a grouping of mirrors able to create the effect, with each newly repeated image being slightly smaller than one to which it is adjacent. One disadvantage of prior art infinity display devices is that once a three-dimensional display object is placed in its operative position relative to the mirrors, it is not easily exchanged for another. This limits the use of prior art devices for display of collections of favored objects to which new additions are periodically being made. Also limited is the ease in which new visual effects can be created by the exchange of a previous collection of objects for one or more new objects. The present invention provides several alternative embodiments for creating an infinity mirror display apparatus that can be effectively used for the display of multiple three-dimensional objects, and then permit the nearly instantaneous exchange or addition of displayed objects, even those requiring a suspended means of support for best viewing.

The prior art device thought to be the closest in concept to the present invention is the invention disclosed in U.S. Pat. No. 2,056,396 to Gorrie (1934) for an advertising display sign having multiple images. However, there are important differences between the Gorrie invention and the present invention. The Gorrie invention discloses an opaque box lined with reflective material that is closed on all sides but one. A rectangular frame having two mirrors covers the open side of the box. The frame is detachably connected to the box, with the disclosure suggesting the use of four rotatable eyelets for such closure, each eyelet being used to secure a flange on the box to the frame in one of its four corners. Each eyelet is secured from the rear surfaces of the box and the frame, where it is remains hidden from a person viewing the infinity display effect through the mirrors supported by the frame. Further, the infinity display effect in the Gorrie invention is produced by portions of the coating on the non-transparent mirror being removed, such as by an etching process. Also, in one embodiment of the Gorrie invention, the etched mirror is removable from the frame, without opening the frame, so that the advertising message can be altered. To reach the chamber of the Gorrie invention, such as to exchange a failed light source, one would have to remove the Gorrie sign from its mounted position, turn it around to gain access to its back surface, rotate each of the four eyelets until each was released from the box flange and frame, and then either lift the box rearwardly away from the frame, or simultaneously turn the box and frame around so that the person attempting to gain access to the chamber is facing the frame and then pull the frame away from the box. Any loose, free-standing objects located within the Gorrie chamber would need to be secured in their usable position or they would be easily displaced during the steps disclosed for opening the Gorrie chamber, and be at a risk for breakage, and/or breakage of the mirrored surfaces supported by the frame. In contrast, the present invention does not require a chamber lined with reflective material, a frame holding an etched reflecting mirror at a spaced-apart distance behind a surface having translucent material, or a light source positioned within the reflective chamber and behind the rear surface of an etched reflecting mirror. Instead, the present invention comprises a housing having a stationary base member and a readily removable cover together defining an enclosed interior spaced into which three-dimensional display objects can be rapidly and easily inserted and removed, with the cover comprising at least one partially reflective mirror through which the display objects can be viewed; at least one display object; at least one light source positioned within the interior space defined by the combined housing and cover to provide illumination for display objects; electrical connection means between the light source and a power supply; and at least one additional partially reflective or fully reflective mirror positioned behind the display objects remote from a viewer, within or adjacent to the interior space defined by the combined stationary base member and cover, and having its reflective surface facing the interior of the housing. A permanently fixed display support can optionally be placed within the housing, with the upper surface of the display support optionally being transparent or translucent. At least one light source may optionally be positioned below the display support. Also any illumination source can be used with the present invention with the illumination source being placed anywhere within the interior space of the housing. The hinged, sliding, or detachable cover, when in its fully opened position, or in one of a plurality of partially opened positions sufficient to permit passage of the largest display object targeted for exchange, will allow one to or more display objects to be nearly instantaneously removed from or added to the housing without having to dislodge the stationary base member from its mounted position, without having to dismantle the housing, without disturbing other display objects within the interior space, and without requiring permanent alteration or modification of the display objects to securely position them within the housing. No device is known that has all of the advantages of the present invention.

SUMMARY OF INVENTION—OBJECTS AND ADVANTAGES

The primary object of this invention is to provide an infinity mirror display apparatus configured for displaying multiple spaced-apart reflections extending rearwardly from one or more display objects positioned in the interior space defined between a stationary base member and a removable cover, and which is adapted to permit nearly instantaneous access to the interior space so that three-dimensional display objects can be quickly and easily added and removed therefrom. It is also an object of this invention to provide an infinity mirror display apparatus that can remain in its mounted position during display object exchange or addition. It is also an object of this invention to provide an infinity mirror display apparatus in which the display objects can be freely exchanged and do not require any permanent modification or alteration for secure positioning within the housing. A further object of this invention is to provide an infinity mirror display apparatus that permits rapid and easy access to its interior space for nearly instantaneous removal or addition of display objects without disturbing other objects already positioned for display within the housing. It is also an object of this invention to provide an infinity mirror display apparatus having light sources that can be positioned anywhere within the interior space of the housing, above or below any display object support, as well as in any direction or orientation relative to display objects that are suspended within the interior space, in direct contact with the bottom interior surface of the stationary base member, or positioned upon a display support.

As described herein, properly manufactured and used, the present invention infinity mirror display apparatus would enable those having a selection of objects for infinity effect display to be able to display one or more of them at a time, or in succession, in a variety of different combinations within the closed interior spaced of a housing defined by a stationary base member and a complementary cover. Its easily-opened hinged, sliding, or detachable cover would comprise at least one partially reflective mirror through which a viewer would observe illuminated display objects and the reflections produced rearwardly therefrom that create the infinity mirror display effect. A second mirror, either a partially reflective or a totally reflective one, is positioned within or adjacent to the interior space behind the object or objects intended for display, remote from the viewer. As soon as the display objects become illuminated by a light source within the interior space, the infinity mirror display effect is created. Placement of the removable cover into its fully opened position, or one of a plurality of partially opened positions sufficient to allow passage of the largest display object targeted for exchange, permits rapid and easy access to the interior space of the housing for nearly instantaneous removal and/or addition of selected display objects, or prompt optional replacement of all display objects within the housing. Rapid opening of the cover can be accomplished through use of one or more hinges on any perimeter edge of the stationary base member, a perimeter groove in the stationary base member that allows the associated cover to slide within the groove between opened and closed positions, or by easily lifting the cover vertically away from its associated stationary base member. Since the cover is easily removed and placed into its fully opened position, or one of a plurality of partially opened positions that allow passage of the largest display object targeted for exchange, display objects can be quickly added or removed from the interior space of the housing without having to dismantle the stationary base member or cover, disturb the stationary base member from its mounted position, and without disturbing other objects already positioned for display within the interior space of the housing. Since the housing would not need to be rotated or positioned on its side for access to its interior space, display objects do not require any permanent modification or alteration for secure positioning within the housing and can be freely and instantaneously lifted from a display position for exchange. Also, since the housing would not need to be rotated or positioned on its side for access to its interior, other objects already positioned for display within the housing are not disturbed when selected display objects are removed and/or when new display objects are added to a collection of objects already on display within the housing. Further, the display objects can be mounted in a variety of positions within the infinity mirror display apparatus housing, such as through use of suction cups or a bonded connection to the partially reflective mirror or mirrors in the cover employed by an observer to view the infinity display effect, one or more transparent or translucent movable support members placed directly upon the bottom interior surface of the housing, flexible filamentous materials suspended from anchoring devices such as hooks or rings supported by the top interior surface of the stationary base member or a multiple-sided cover, and elevated support members detachably and adjustably connected to peg holes formed in or attached to the vertically extending walls of a stationary base member or a multiple-sided cover. As a result, the light sources used to illuminate the diversely positioned display objects can also be positioned within any part of the housing and in any direction or orientation relative to the display objects, often providing illumination from below. Also, the size, number, and orientation of the mirrors relative to one another can be varied, and although a more uniform infinity display effect is created when there is a close positioning of display object and mirror, interesting infinity display effects can also be created when more than two mirrors are used and when mirrors are positioned at oblique angles relative to one another. Therefore the configuration and dimensions of the stationary base member and cover are not limited as long as together they provide a means of enclosed support for all of the mirrors selected for use, as well as an enclosed interior space of sufficient dimension for housing the maximum number of objects intended simultaneous display and the amount of illumination needed to create a pleasing infinity display effect therewith. As a result, it is contemplated that the size of a housing used in the present invention would depend upon factors such as but not limited to the cost of the materials used for its construction, the size and decor of the room where it would be used, and whether it would be wall-mounted or table-mounted. Further, when restricted access to one or more display objects within the interior space is desired, it is contemplated for the present invention to comprise a locking device that would prevent unauthorized separation of the cover from the stationary base member.

The description herein provides the preferred embodiments of the present invention but should not be construed as limiting the scope of the infinity mirror display apparatus. For example, variations in the length, width, and thickness dimensions of the stationary base member and its complementary cover; the size of the interior space defined by the stationary base member and its complementary cover; the total surface area of each of the mirrors used to create the infinity display effect relative to the others; the type of locking means optionally used between the cover and the stationary base member to prevent unauthorized access to the interior space; and the means used to securely position display objects within the interior space of the housing other than those shown and described herein may be incorporated into the present invention. Thus the scope of the present invention should be determined by the appended claims and their legal equivalents, rather than the examples given.

BRIEF DESCRIPTION OF THE DRAWINGS

FIG. 9 is a front perspective view of an eighth preferred embodiment of the present invention having a hexagonal housing with a substantially planar platform-like stationary base member and a display support with a transparent or translucent top surface positioned above the stationary base member, a display object being supported by a movable support member centrally atop the display support, multiple lights positioned under the perimeter of the display support, and a box-like cover that can be vertically lifted from the stationary base member to give access to the interior space defined by the stationary base member and the cover, the cover being poised over the stationary base member in an open position allowing display object exchange, the cover comprising adjoining frameless partially reflective mirrors.

DETAILED DESCRIPTION OF PREFERRED EMBODIMENTS

Figure 1:
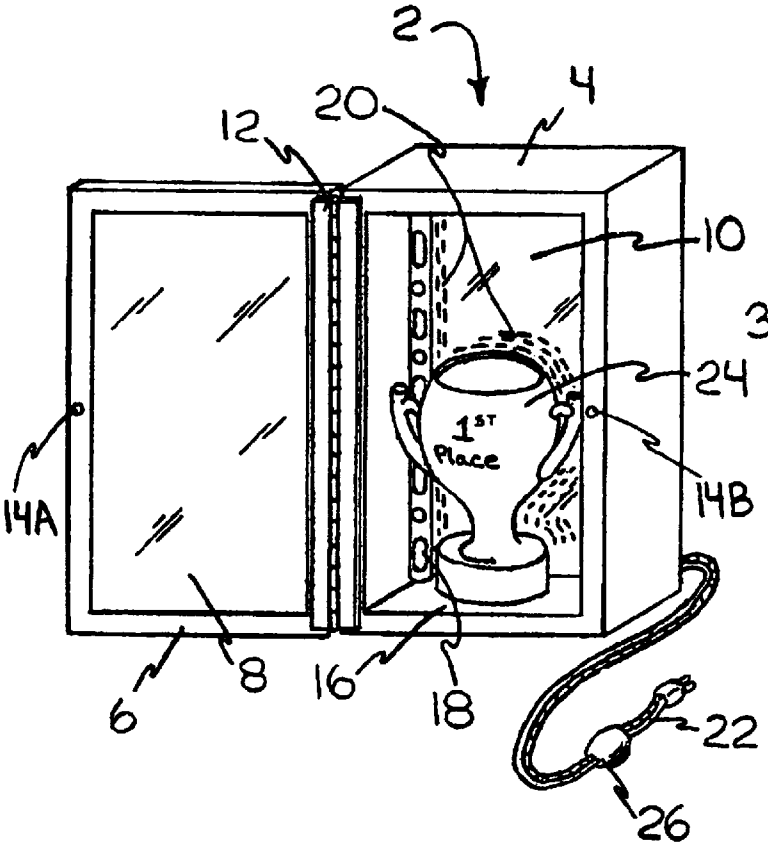
FIG. 1 is a front perspective view of a first preferred embodiment of the present invention having a rectangular housing with a box-like stationary base member and a totally reflective mirror attached to its rear inside surface, a substantially planar cover hinged to one side of the stationary base member and comprising a partially reflective mirror supported by a frame, closure means between the stationary base member and the cover, multiple lights vertically extending in opposed lateral positions within the interior space adjacent to the totally reflective mirror, and one display object positioned within the interior space and being supported directly by the housing.

FIG. 1 shows a first preferred embodiment 2 of the present invention having a rectangular housing with a box-like stationary base member 4 having five enclosed sides, an open sixth side, and a totally reflective mirror 10 attached to its rear inside surface. Although not limited thereto, first preferred embodiment 2 would preferably be wall-mounted, with it totally reflective mirror 10 generally being in a position remote from an observer (not shown). Since it is contemplated for any commonly used type of wall mounting bracket or means to be attached to or used within the back surface of stationary base member 4 for securing it against a wall surface, and further since the number of mounting brackets or other type of mounting means used is also not critical, illustrations of the mounting hardware alternatives possible for wall attachment of first preferred embodiment 2 have not been provided. FIG. 1 also shows first preferred embodiment 2 having a substantially planar cover 6 attached to one side of stationary base member 4 with an elongated hinge 12. Although FIG. 1 shows one elongated hinge 12, the use of a single elongated hinge 12 is not critical and it is also considered to be within the scope of the present invention for first preferred embodiment 2 to have other types and sizes of connecting devices between cover 6 and stationary base member 4, including releasable fasteners such as magnetic fasteners 30*a* and 30*b* shown in FIG. 2, locking fasteners such as keyed fastener 44 shown in FIG. 3, supportive grooves, such as groove 48 shown in FIG. 4, and other similar devices that securely hold cover 6 against stationary base member 4 while at the same time are easily manipulated by a user for prompt separation of cover 6 from stationary base member 4. Also, the side of stationary base member 4 to which hinge 12 is attached is not critical, and as an alternative to the left perimeter edge of stationary base member 4 shown in FIG. 1, hinge 12 could also be attached to the right perimeter edge of stationary base member 4, its top perimeter edge wherein the bottom edge of cover 6 would open in a forward and upwardly direction, or the bottom perimeter edge of stationary base member 4 wherein the top edge of cover 6 would open in a forward and downwardly direction. Since the infinity display effect requires a minimum of two mirrored surfaces, with at least one being partially reflective, FIG. 1 shows cover 6 comprising a partially reflective mirror 8 centrally supported within a frame to complement the totally reflective mirror 10 attached to the back interior surface of stationary base member 4 for infinity display effect purposes. Cover 6 would not need to be totally closed against stationary base member 4 for viewing an infinity display effect through partially reflective mirror 8, however, the number of repeated images in the infinity display effect decreases as hinged cover 6 is rotated away from totally reflective mirror 10. Although not shown in FIG. 1, but visible in FIG. 7 and identified by the number 86, it is contemplated and preferred for partially reflective mirror 8 to be held securely within the frame of cover 6 by a minimum of four angular S-shaped mounting brackets 86, each in contact with partially reflective mirror 8 and the frame of cover 6 near to their respective corners. However, although it is contemplated for angular S-shaped mounting brackets 86 to be used in first preferred embodiment 2, the use of angular S-shaped mounting brackets 86 is not critical, and it is considered within the scope of the present invention for other types and configurations of commonly used mirror-to-frame mounting brackets to be employed. When there is no illumination between partially reflective mirror 8 and totally reflective mirror 10, partially reflective mirror 8 would reflect the image of an observer viewing it. However, when illumination does exist behind partially reflective mirror 8, an observer would be able to see through partially reflective mirror 8 and view illuminated objects positioned behind it, such as display object 24 in FIG. 1, which is shaped as a trophy and shown positioned directly on the bottom inside surface 16 of stationary base member 4. Since cover 6 is easily opened without disturbing stationary base member 4, display objects 24 would not need to be permanently secured or anchored within stationary base member 4, during their use in providing an infinity display effect. In the first preferred embodiment 2 shown in FIG. 1, the left and right sides of stationary base member 4 are unmarked as being opaque, with the sole partially reflective mirror 8 used being a part of cover 6. However, variations of the first embodiment also considered within the scope of the present invention could include either the left or right side of stationary base member 4, or both, containing partially reflective mirrors 8, cover 6 containing more than one partially reflective mirror 8, the top surface of stationary base member 4 containing a partially reflective mirror 8, and even the back surface of stationary base member 4 containing a partially reflective mirror 8 in place of totally reflective mirror 10, particularly when a bottom positioned source of light is used, such as light source 32 shown in FIG. 2, instead of the elevated strand of multiple miniature lights 18 used in the first preferred embodiment 2.

Figure 5:
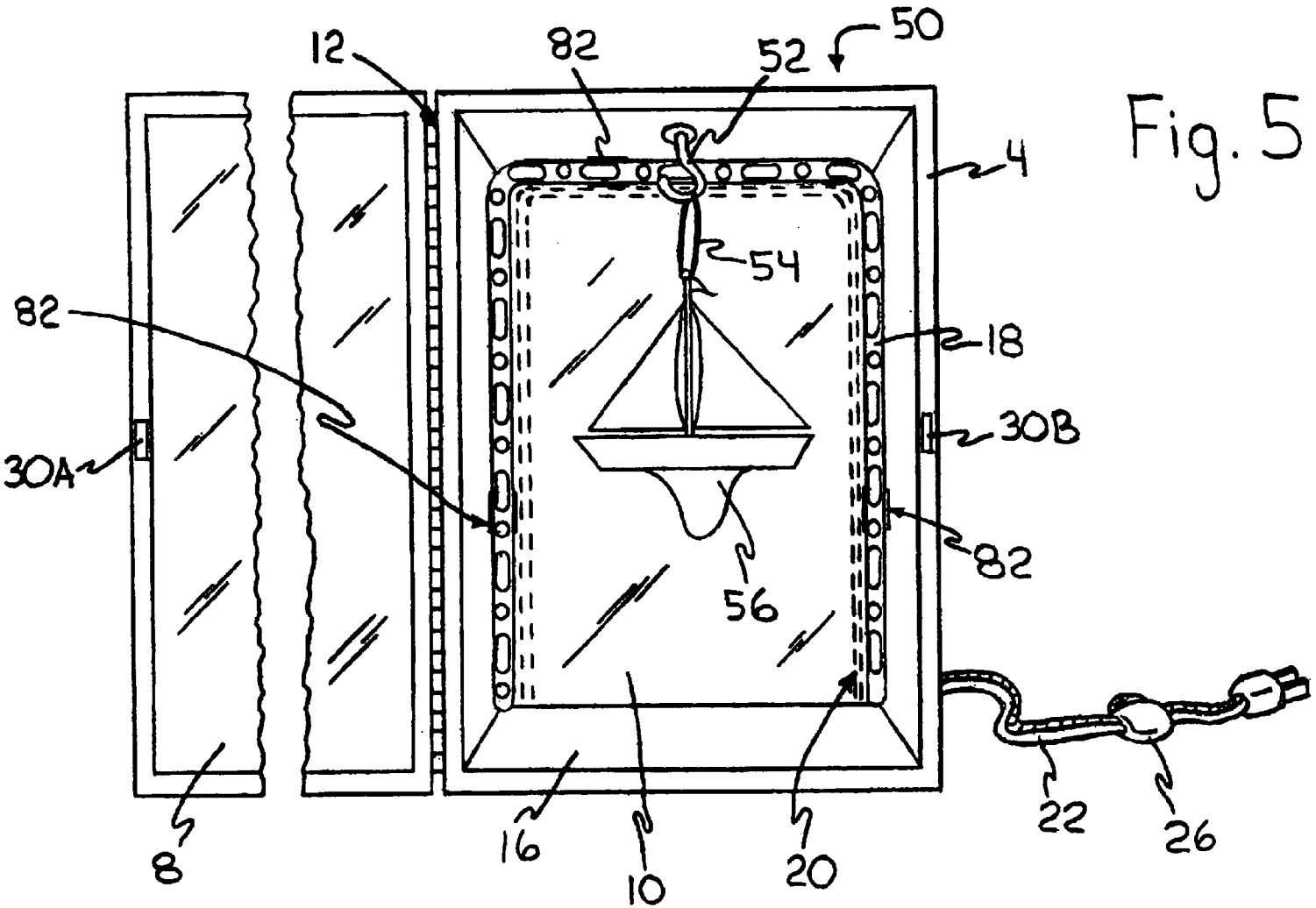
FIG. 5 is a front perspective view of a fourth preferred embodiment of the present invention having a rectangular housing with a box-like stationary base member and a mirror attached to its rear inside surface, a substantially planar cover hinged to one side of the stationary base member and comprising a frameless partially reflective mirror, magnetic closure means positioned between the stationary base member and the cover, multiple lights positioned within the interior space defined by the stationary base member and the cover, and placed laterally against the totally reflective mirror that is attached to the rear inside surface of the stationary base member, a hooked display object support device and cord adapted for suspending a display object within the interior space, and one suspended display object connected to the hooked display support device.

FIG. 1 also shows a two-part fastener consisting of first fastener 14*a* and second fastener 14*b* being used to achieve secure closure of cover 6 against stationary base member 4 when cover 6 is in its fully closed position. The type of fastening means used for first fastener 14*a* and second fastener 14*b* is not critical and any type or number of secure but easily opened closure means, such as a snap-fit type of closure, as well as locking closure means between the stationary base member 4 and cover 6, such as keyed fastener 44 in FIG. 3, are considered to be within the scope of the present invention as long as all are easily manipulated for prompt access to the interior space defined between stationary base member 4 and cover 6. A handle could optionally be positioned on the reverse side of cover 6 not visible in FIG. 1, anywhere along the distal edge of the frame of cover 6 in a position remote from hinge 12. However, generally a handle is not preferred and instead cover 6 can be made to slightly overlap the perimeter of stationary base member 4, at least on the perimeter edge of the frame of cover 6 that is remote from hinge 12, so as to provide an easily gripped hand-hold for manipulating cover 6 between its fully closed position and its fully open position. FIG. 1 also shows a strand of multiple miniature lights 18 extending vertically along the left side of display object in a position adjacent to the perimeter edge of totally reflective mirror 10. Since no infinity mirror effect would be possible with cover 6 in its fully opened position, only a single reflected image 20 of miniature lights 18 and display object 24 are shown behind them. Since it is preferred that miniature lights 18 would extend across the top perimeter edge of totally reflective mirror 10, as well as along both vertically extending side perimeter edges, a reflected image 20 of miniature lights 18 is also shown to the right of display object 24, the miniature lights 18 on the right side of display object 24 remaining hidden from view behind stationary base member 4. Although not shown in FIG. 1 and not necessarily needed if a display support 34 is used beneath display object 24, similar to that shown in FIG. 2, since display support 34 would preferably have small openings therethrough laterally on its back edge for securing the ends of miniature lights 18, in the first preferred embodiment 2 miniature lights 18 could be supported by several small transparent, translucent, or opaque U-shaped brackets 82, as shown in FIG. 5. Secure attachment of U-shaped brackets 82 to totally reflective mirror 10 could be achieved by-adhesive or bonding agent means (not shown). FIG. 1 also shows the electrical cord 22 needed for connecting miniature lights 18 to a source of electrical power (not shown) and an on-off switch 26 for use in activating miniature lights 18 for illumination of display object 24 and the instantaneous creation of an infinity mirror display effect when cover 6 is fully closed, or nearly closed, against stationary base member 4 and display object 24 is viewed through partially reflective mirror 8. Although it is preferred for electrical cord 22 to extend through a small opening in the back surface of stationary base member 4 near to its bottom surface, and for on-off switch 26 to be conveniently positioned close to stationary base member 4 for easy access thereto, such connections are not critical. Further, although on-off switch 26 is shown to have a rotating disk type of switch activation means for aesthetic purposes, it is considered to be within the scope of the present invention, although not shown, for on-off switch 26 to also have a toggle, depressible button, rotatable knob, or other type of electrical activation means.

The materials used for cover 6 and stationary base member 4 in first preferred embodiment 2 can vary, and although not limited thereto it is contemplated for the frame portion of cover 6 and stationary base member 4 to be made from rigid materials capable of respectively supporting totally reflective mirror 10 and partially reflective mirror 8, such as but not limited to wood, metal, plastic materials, ceramic materials, and the like. Although not shown, the interior surfaces of stationary base member 4, other than the back interior surface to which totally reflective mirror 10 is attached, can be lined with a fabric, such as felt, other aesthetically pleasing materials. However, if such lining materials were used, although not limited thereto, they generally would consist of non-shiny fabrics in a variety of dark or subdued colors, unless needed for a particular use to enhance an infinity display effect. Also, although it is contemplated in first preferred embodiment 2 for totally reflective mirror 10 and partially reflective mirror 8 to be made from glass and for totally reflective mirror 10 to be a conventional silvered mirror, it is considered to be within the scope of the present invention for totally reflective mirror 10 and partially reflective mirror 8 to comprise other reflective materials. Also in the first preferred embodiment 2 shown in FIG. 1, although totally reflective mirror 10 and partially reflective mirror 8 are shown to be substantially parallel to one another, positioning at oblique angles relative to one another can provide pleasing visual effects and therefore respective oblique positioning of totally reflective mirror 10 and partially reflective mirror 8 to the other is also considered to be within the scope of the present invention.

Although not limited thereto and provided herein only as an example, the dimensions of first preferred embodiment 2 for creating a pleasing infinity display effect with a display object 24 having a height dimension of approximately four inches and a diameter dimension of approximately two-and-one-half inches, could include box-like stationary base member 4 having a width dimension of approximately ten inches, a height dimension of approximately twelve inches, and a depth dimension of approximately four inches. Corresponding dimensions for cover 6, which would provide a small amount of stationary base member 4 overlap to create a hand-hold for easily opening cover 6 without the need for a handle, would include a width dimension of approximately ten-and-one-half inches, a height dimension of approximately twelve-and-one-half inches, and a depth dimension of approximately one-half of an inch. Cover 6 would have a centrally positioned opening with width and height dimensions respectively of approximately seven and nine inches, through which partially reflective mirror 8 is used to view display objects 24 positioned within the interior space defined by cover 6 and stationary base member 4. To center the slightly larger cover 6 against stationary base member 4, hinge 12 would be attached between the rear surface of cover 6 and stationary base member 4, as is more clearly illustrated in FIG. 2, with hinge 12 generally hidden from an observer by the perimeter edge of cover 6. As an alternative to one elongated hinge 12 having a length dimension of approximately eleven inches, the first preferred embodiment could also comprise two smaller hinges 12 each having a length dimension of approximately one-and-one-half inches and a spaced-apart distance therebetween of approximately five inches. Also in first preferred embodiment 2, partially reflective mirror 8 would have width, height, and thickness dimensions respectively of approximately eight-and-one-half inches, ten-and-one-half inches, and one-fourth of an inch. Similarly, totally reflective mirror 10 would also have width, height, and thickness dimensions respectively of approximately eight-and-one-half inches, ten-and-one-half inches, and one-fourth of an inch. If a supporting surface other than the bottom inside surface 16 of stationary base member 4 were used for display object 24, such as the display support 34 shown in FIG. 2, it would have approximately length, height and depth dimensions of nine inches, one-and-one-half inches, and two-and-one-half inches. When a strand of miniature lights 18 are used against the top and side perimeter edges of totally reflective mirror 10 for the illumination of display objects 24 placed between totally reflective mirror 10 and partially reflective mirror 8, it is preferred for miniature lights 18 to have a maximum diameter dimension of approximately one-half inch. Also, when display support 34 is used with miniature lights 18, although not shown, it is contemplated that a small opening would be placed laterally through each back edge of display support 34 for the insertion therethrough of a different one of the opposing ends of miniature lights 18 to help secure miniature lights 18 in their usable position. In the first preferred embodiment electrical cord 22 would be approximately four feet in length, with on-off switch 26 being connected to electrical cord 22 within a conveniently accessible distance of approximately eight inches from stationary base member 4. On-off switch 26 would preferably have a maximum length dimension of approximately one-and-one-half inches, and maximum width and depth dimensions of approximately one-half of an inch. On-off switch 26 would also preferably have one rotating disk for use in activating miniature lights 18, although other activation means such as a depressible button, rotatable knob, or toggle switch (not shown) could also be used. When the above dimensions are used in first preferred embodiment 2, and an observer's line of sight is approximately directed to the top of display object 24, the infinity mirror display effect created rearwardly from display object 24 will extend nearly to top perimeter edge of totally reflective mirror 10.

Figure 2:
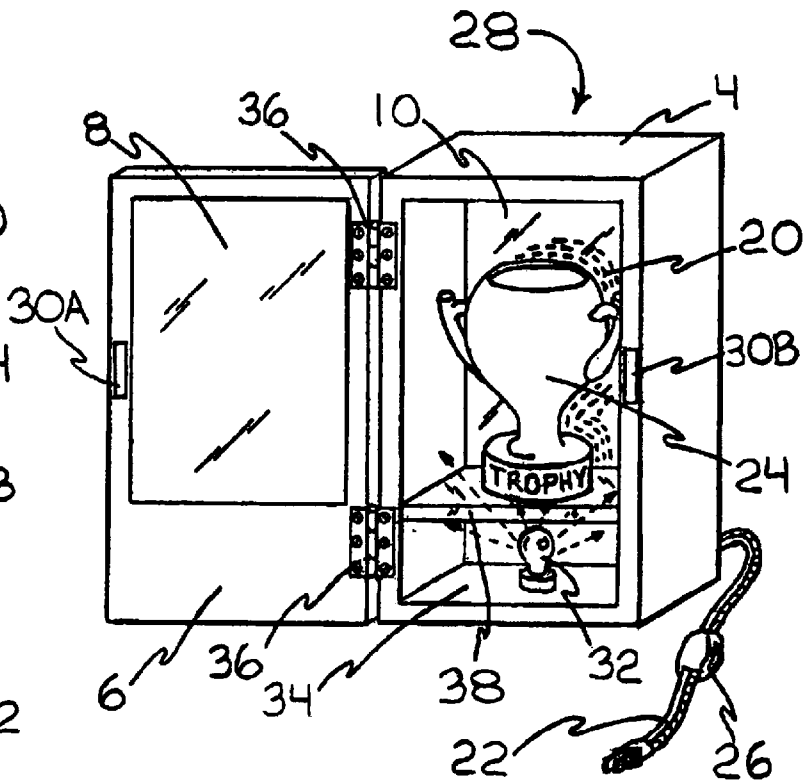
FIG. 2 is a front perspective view of a second preferred embodiment of the present invention having a rectangular housing with a box-like stationary base member and a totally reflective mirror attached to its rear inside surface, a substantially planar cover hinged to one side of the stationary base member and comprising a partially reflective mirror supported by a frame, magnetic closure means positioned between the stationary base member and the cover, a rectangular display support having a transparent or translucent upper surface and being positioned within the bottom part of the stationary base member, a light source positioned below the display support, and one display object placed directly on the upper surface of the display support.
Figure 3:
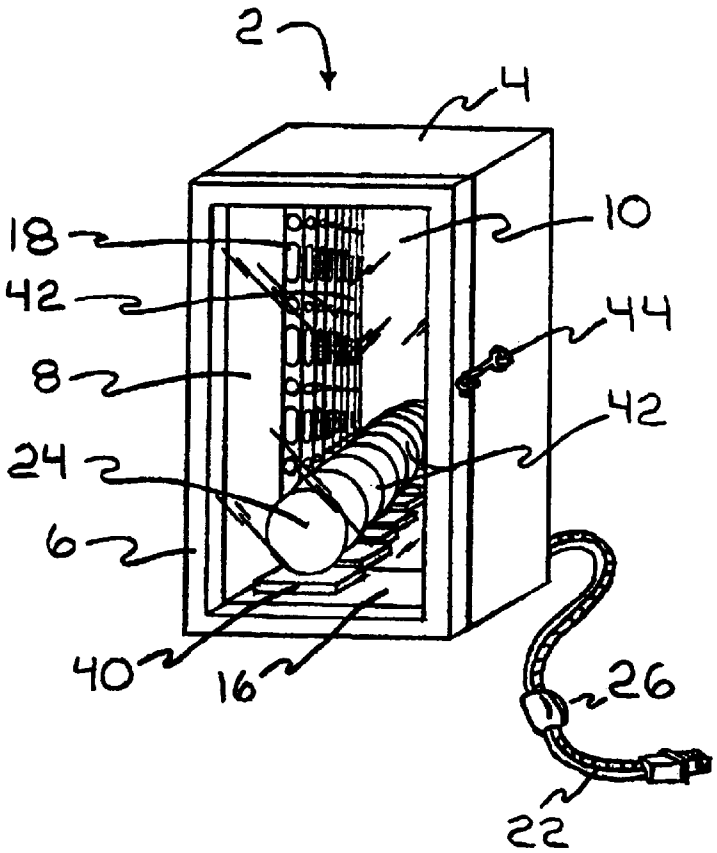
FIG. 3 is a front view of the first preferred embodiment of the present invention having its cover in a fully closed position, a locking closure means for the cover, a display object positioned upon a movable support member within the interior space defined by the box-like stationary base member and the cover, and multiple reflective images creating an infinity mirror effect extending rearwardly from the display object, the movable support member, and the multiple lights positioned laterally against the totally reflective mirror that is attached to the rear inside surface of the stationary base member.

FIG. 2 shows a second preferred embodiment 28 of the present invention having a rectangular housing with a box-like stationary base member 4 and a totally reflective mirror 10 attached to its rear inside surface, as well as a substantially planar cover 6 comprising a partially reflective mirror 8 supported by a frame attached to one side of stationary base member 4 with two hinges 36. FIG. 2 also shows a magnetic closure means, between stationary base member 4 and cover 6, comprising first magnet 30*a* attached to the freely moving inside perimeter edge of cover 6 remote from hinges 36, and a second magnet 30*b* attached to the stationary base member 4 in a cooperative position relative to first magnet 30*a*. However, it is contemplated for second preferred embodiment 28 to have other easily opened closure means and not be limited to the use of first magnet 30*a* and second magnet 30*b*. FIG. 2 further shows a substantially rectangular display support 34 having a transparent or translucent upper surface 38 positioned within the bottom portion of stationary base member 4. One display object 24 is placed directly on upper surface 38 with several upwardly directed arrows representing light emitted from a light source 32 positioned beneath upper surface 38. It is contemplated that light source 32 would provide adequate illumination for display object 24 to create a pleasing infinity display effect without generating an excessive amount of heat. FIG. 2 also shows an electrical cord 22 and a connected on-off switch 26 that would extend through stationary base member 4, preferably through the lower back surface of stationary base member 4, and be electrically connected to light source 32 for activation thereof and creation of an infinity display effect. The dimensions and configuration of display support 34 are not critical, and it is considered to be within the scope of the present invention for display support 34 to be three-sided and have upper surface 38 supported by opposed downwardly depending front and back support members or opposed downwardly depending end support members; for display support 34 to be four-sided and have upper surface 38 supported by a downwardly depending front support member and opposing downwardly depending end support members; display support 34 to be five-sided and have upper surface 38 supported by opposed downwardly depending front and back support members as well as opposed downwardly depending end support members; or for display support 34 to be six-sided and have a bottom support member opposed to upper surface 38. Although not critical, display support 34 could be made from wood or wood products, plastic, metal, and the like. However, generally the front support member downwardly depending from transparent or translucent upper surface 38 would be opaque so as to hide light source 32 from an observer looking through partially reflective mirror 8. Also, although not shown in FIG. 2, display support 34 could be covered with non-reflective fabric, such as felt, having dark and/or subdued colors. Since cover 6 is in an opened position and display object 24 is not viewed through partially reflective mirror 8, only one reflected image 20 of display object 24 is shown in FIG. 2.

FIG. 3 shows first preferred embodiment 2 having cover 6 with partially reflective mirror 8 in a fully closed position against stationary base member 4, and a display object 24 positioned upon a movable support member 40, with the interior space within which display object 24 is positioned being defined by box-like stationary base member 4 and cover 6. Movable support member 40 is placed directly upon the bottom inside surface 16 of stationary base member 4 and would be required only when display object 24 is unable to remain in a stable fixed position upon bottom inside surface 16 without assistance. FIG. 3 also shows multiple reflective images 42 creating an infinity mirror display effect extending rearwardly from display object 24, as well as rearwardly from the strand of miniature lights 18 vertically extending along the left perimeter edge of totally reflective mirror 10 that is attached to the rear inside surface of stationary base member 4. Although not limited thereto, the miniature lights 18 shown in FIG. 3 are elongated and tubular, the outer casing preferably made from a transparent flexible plastic material, with a series of incandescent lighting elements positioned therein. FIG. 3 further shows cover 6 being secured to stationary base member 4 through use of an elongated hinge 12 and a keyed fastener 44 which would prevent unauthorized access to the interior space defined by stationary base member 4 and cover 6. In the variations of the first preferred embodiment 2 in which cover 6 overlaps stationary base member 4 to provide a hand-hold for assistance in moving cover 6 between its fully open position and its fully closed position, hinge 12 would remain hidden from view behind the overlapping portion of cover 6. FIG. 3 also shows electrical cord 22 extending from the lower back surface of stationary base member 4 and on-off switch 26 in its preferred location close to stationary base member 4. For illustrative purposes, electrical cord 22 is shown in a shortened condition.

Figure 4:
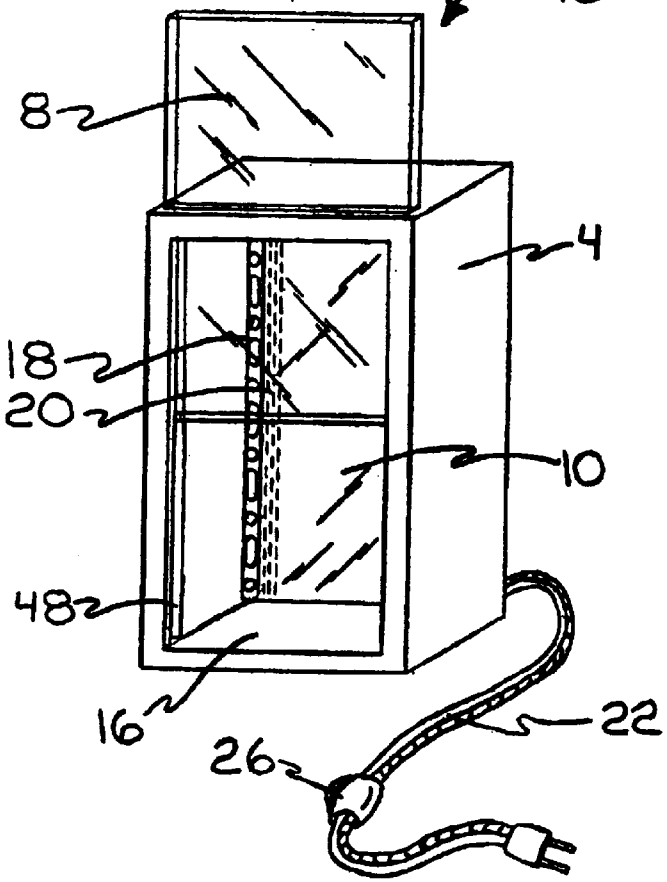
FIG. 4 is a front perspective view of a third preferred embodiment having a rectangular housing with a box-like stationary base member and a mirror attached to its rear inside surface, a substantially planar cover vertically slidable within grooves formed laterally in the stationary base member near to its front perimeter, the cover comprising a frameless partially reflective mirror, and multiple lights positioned within the interior space defined by the stationary base member and the cover, and placed laterally against the totally reflective mirror that is attached to the rear inside surface of the stationary base member.

FIG. 4 shows a third preferred embodiment 46 having a rectangular housing with a box-like stationary base member 4 and a fully reflective mirror 10 attached to the rear inside surface of stationary base member 4 in a position remote from a viewer (not shown). A substantially planar cover 6 comprising a frameless partially reflective mirror 8 is vertically slidable within groove 48 formed in stationary base member 4 near to its front perimeter. Although hidden from view in FIG. 4, it is also contemplated for a second groove 48 to be formed in stationary base member 4 near to its front perimeter in a position opposed to the to visible groove 48. Both grooves 48 would substantially extend the full vertical dimension of stationary base member 4. Although not shown, it is contemplated for one or more display objects 24 to be placed upon the bottom inside surface 16 of stationary base member 4 for use in creating an infinity mirror display effect when unframed partially reflective mirror 8 is fully lowered against bottom inside surface 16. FIG. 4 also shows a strand of miniature lights 18 vertically extending along the left side of totally reflective mirror 10, and a single reflected image 20 of miniature lights 18. Although hidden from view in FIG. 4, it is also contemplated for miniature lights 18 to extend in an approximately horizontal position along the top perimeter of totally reflective mirror 10 as well as along the right side of totally reflective mirror 10. Also, although not shown in FIG. 4 for clarity of illustration, in the third preferred embodiment 46 several small transparent, translucent, or opaque U-shaped brackets 82, similar to those shown in FIG. 5 could be used to support miniature lights 18. In the third preferred embodiment 46, it is also contemplated that secure attachment of U-shaped brackets 82 to totally reflective mirror 10 could be achieved by adhesive or bonding agent means (not shown). If a display support 34 with a translucent or transparent upper surface 38 and a light source 32 were used in the third preferred embodiment to assist in support and illumination of a display object 24, one or more of the top and side surfaces of stationary base member 4 could also comprise partially reflective mirrors 8 to further enhance the infinity mirror display effect. In addition, the back surface of stationary base member 4 could also comprise a partially reflective mirror 8 in place of totally reflective mirror 10. FIG. 4 also shows electrical cord 22 extending from the lower back surface of stationary base member 4 and on-off switch 26 in its preferred location close to stationary base member 4. For illustrative purposes, electrical cord 22 is shown in a shortened condition.

FIG. 5 shows a fourth preferred embodiment 50 of the present invention having a rectangular housing with a box-like stationary base member 4 and a totally reflective mirror attached to its rear inside surface. Although a substantially planar cover consisting of a frameless partially reflective mirror 8 is attached with an elongated hinge 12 to one side of stationary base member 4, it is considered to be within the scope of the present invention for partially reflective mirror 8 to be attached by hinge 12 to any front perimeter edge of stationary base member 4, including the top and bottom perimeter edges wherein partially reflective mirror 8 would move vertically between open and closed positions. FIG. 5 also shows a two-part closure means between partially reflective mirror 8 and stationary base member 4 in a position remote from hinge 12. Although the type of closure means is not critical, nor is the number of closure devices used, it is considered to be within the scope of the present invention for the two-part closure means to comprise any type of easily opening means of securing partially reflective mirror 8 against stationary base member 4. FIG. 5 shows the two-part closure means between partially reflective mirror 8 and stationary base member 4 comprising first magnet **30*a* attached to the freely moving inside perimeter edge of partially reflective mirror 8, in a position remote from hinge 12, and a second magnet 30*b* attached to the stationary base member 4 in a cooperative position relative to first magnet 30*a*. FIG. 5 further shows an anchoring device 52 attached to the inside top surface of stationary base member 4, one suspended display object 56 in the shape of a sailboat substantially centered in front of totally reflective mirror 10 and hanging above bottom inside surface 16, and a loop of filamentous material 54 supporting suspended display object 56 from anchoring device 52. Although FIG. 5 shows anchoring device 52 in the form of a hook, it is also considered to be within the scope of the present invention for other types of anchors to be used, such as but not limited to a closed ring attached to the top inside surface of stationary base member 4, with suspended display object 56 supported by an elongated piece of filamentous material 54 having one end secured around display object 56 and the other end having a hooked member (not shown) configured for rapid engagement with, and release from, such an anchoring ring. At a minimum filamentous material 54 must have the tensile strength necessary to support the heaviest suspended display object 54 contemplated for use with fourth preferred embodiment 50, to include but not be limited to differing types of cords, cables, chains, string, crochet thread, heavy metallic threads, yarn, and the like. Also, it is considered to be within the scope of the present invention for more than one anchoring device 52 to be simultaneously attached to the top inside surface of stationary base member 4 for support of a single large suspended display object 56 or several small suspended display objects 56. FIG. 5 further shows miniature lights 18 for the illumination of suspended display object 56 being positioned in front of the top and side perimeter edges of totally reflective mirror 10 and an electrical cord 22 having an on-off switch 26 connected thereto extending from the back of stationary base member 4 for use in electrically connecting miniature lights 18 to a power source (not shown). It is contemplated that miniature lights 18 would provide adequate illumination for suspended display object 56 to create a pleasing infinity display effect without generating an excessive amount of heat. Although one mounting device 82 is shown supporting miniature lights 18 along each perimeter edge of totally reflective mirror 10, the use of mounting devices 82 would be optional when miniature lights 18 have a supportive plastic tubing with sufficient rigidity that allows them to remain unassisted in fixed positions between the opposing inside corners of stationary base member 4. When mounting devices 82 are used, a U-shaped configuration is preferred as it provides for rapid connection and removal of miniature lights 18. However, the number, configuration, color, and transparency characteristics of the mounting devices 82 used in fourth embodiment 50 is not critical as long as mounting devices 82 provide the needed assistance to secure miniature lights 18 into a substantially fixed position relative to suspended display object 56 for effective illumination thereof and creation of an easily viewed and pleasing infinity mirror display effect. The means of attachment between U-shaped mounting devices 82 and totally reflective mirror 10 is not shown, and could include any one of a variety of commonly used adhesives or bonding agents suited for such purpose. Further, since partially reflective mirror 8 is in an open position relative to stationary base member 4, and suspended display object 56 cannot be viewed therethrough to create an infinity mirror display effect, a single reflected image 20 of miniature lights 18 is visible. In addition, since FIG. 5 shows suspended display object 56 from a front perspective view, no reflected image 20 is visible behind suspended display object 56**.

Figure 6:
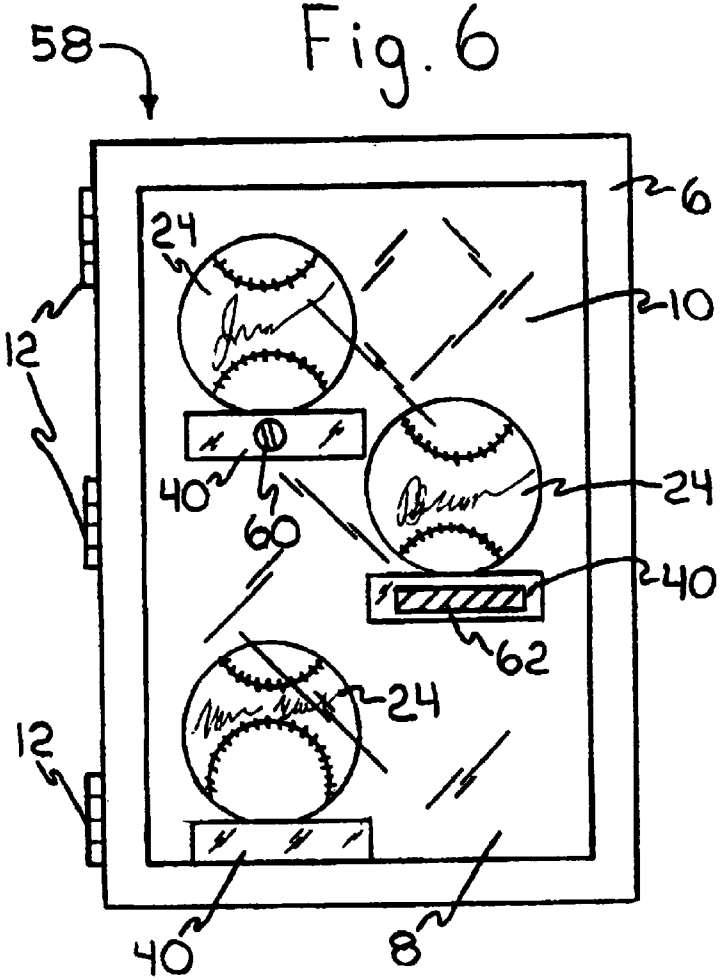
FIG. 6 is a front view of a fifth preferred embodiment of the present invention having a rectangular housing with a hinged front cover made from a partially reflective mirror supported by a frame, the cover being in its fully closed position, a rearwardly positioned mirror, and three display objects positioned between the cover and the rearwardly positioned mirror, one of the display objects being positioned upon a movable support member placed on the bottom interior surface of the housing, and two additional display objects each being positioned upon a movable support member, with one of the movable support members being attached to the partially reflective mirror by suction cup means and the other movable support member being bonded to the partially reflective mirror.

FIG. 6 shows a fifth preferred embodiment 58 of the present invention having a rectangular housing with a hinged front cover 6 made from a partially reflective mirror 8 supported by a frame. FIG. 6 shows cover 6 being in its fully closed position. The box-like stationary base member 4 to which cover 6 is attached by the three hinges 12 remains hidden from view behind cover 6. The illumination means for display objects 24 are also hidden from view by closed cover 6, however, an electrical cord 22 and an on-off switch 26 connected thereto are shown extending from the right side or rear surface of fifth embodiment 58. FIG. 6 also shows fifth preferred embodiment 58 having a rearwardly positioned mirror 10, and three display objects 24 positioned between cover 6 and the rearwardly positioned mirror 10. The lowest positioned display object 24 is positioned upon a movable support member 40 placed on the bottom interior surface 16 of the housing (shown in FIG. 5, but not visible in FIG. 6). The remaining two display objects 24 are also each positioned upon a movable support member 40, one with its movable support member 40 attached to partially reflective mirror 8 by suction cup means 60, and the other movable support member 40 being attached to partially reflective mirror 8 by bonding/adhesive means 62. Variations of the fifth preferred embodiment 58, although not limited thereto, could include substitution of a suspended display object 56 for the movable support member 40 attached to partially reflective mirror 8 with suction cup means 60 and its supported display object 24; sole use of movable support members 40 having suction cup means 60; sole use of movable support members 40 attached to partially reflective mirror 8 by bonding/adhesive means 62, and se of one elongated hinge 12. When the fifth preferred embodiment 58 is wall-mounted, it is contemplated for rewardly positioned mirror 10 to be totally reflective. However, when preferred embodiment 58 is contemplated for table-mounted use, any or all of the five exposed surfaces of cover 6 and stationary base member 4 could comprise partially reflective mirrors 8.

Figure 7:
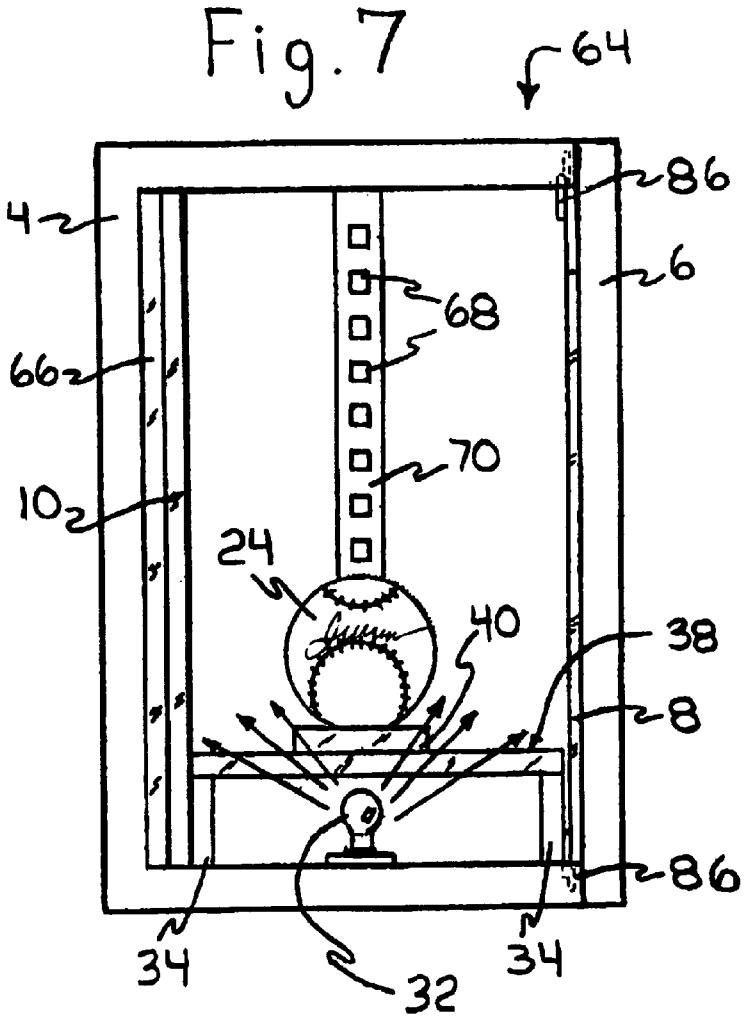
FIG. 7 is a left side view of a sixth preferred embodiment of the present invention having a housing with a box-like stationary base member and a mirror attached to its rear inside surface with the reflective surface against the rear inside surface of the stationary base member, a substantially planar cover closed against the stationary base member and comprising a partially reflective mirror supported by a frame, a display support having a transparent or translucent upper surface positioned in the bottom part of the stationary base member, a light source positioned under the display support, a display object positioned on top of a movable support member placed centrally upon the display support, and a vertically extending mounting strip on the wall of the housing behind the display object with holes therein for adjustable positioning of elevated support members having complementary protrusions for the optional elevated display of additional objects between the stationary base member and its cover.
Figure 8:
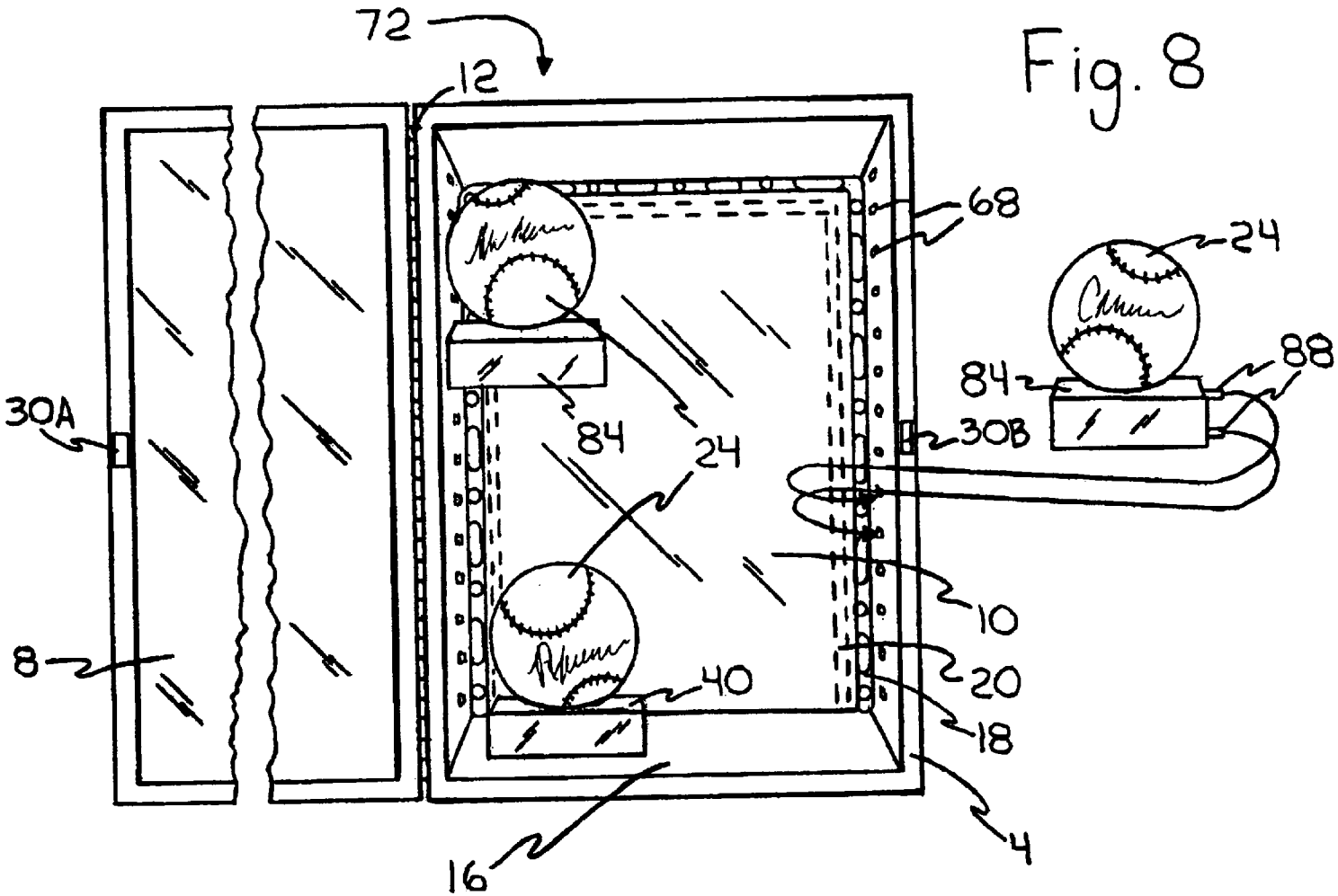
FIG. 8 is a front view of a seventh preferred embodiment of the present invention having a housing with a box-like stationary base member and a mirror attached to its rear inside surface, a substantially planar cover hinged to one side of the stationary base member and comprising a frameless partially reflective mirror supported by a frame, two-part closure means for securely positioning the cover against the stationary base member when the cover is in its fully closed position, multiple lights positioned within the interior space defined by the stationary base member and the cover, three display objects positioned between the cover and the rearwardly positioned mirror, two opposed sets of vertically extending peg holes formed in the sides of the stationary base member with each set being on a different side of the display objects and adapted for adjustable positioning of elevated support members at different heights within the interior space, with one of the display objects being positioned upon a movable support member placed on the bottom interior surface of the housing, and a second display object being positioned upon an elevated support member attached to two peg holes on one side of the stationary base member, and a third display object positioned upon an elevated support member having protrusions and ready for connection to peg holes on the opposed side of the stationary base member.

FIG. 7 shows a sixth preferred embodiment 64 of the present invention having a housing with a box-like stationary base member 4 and a totally reflective mirror 10 attached to the rear inside surface of the stationary base member 4 with the reflective surface 66 of totally reflective mirror 10 positioned against the rear inside surface of stationary base member 4. FIG. 7 also shows sixth preferred embodiment 64 having a substantially planar cover 6 adjacent to stationary base member 4 in a position remote from totally reflective mirror 10. Angled S-shaped brackets 86 hold a partially reflective mirror 8 against the rear inside surface of cover 6. Although not shown in FIG. 7, but shown in FIGS. 1–3 and FIG. 6, cover 6 has a large central opening through which partially reflective mirror 8 is exposed. FIG. 6 shows cover 6 in a fully closed position against stationary base member 4. FIG. 7 further shows a display object 24 positioned on a movable support member 40, with movable support member 40 centrally positioned upon the upper surface 38 of a display support 34. As can be seen by the upwardly directed arrows originating from light source 32 positioned beneath display support 34, it is contemplated for upper surface 38 and movable support means 40 to be transparent or translucent to provide illumination of display object 24 for creation of an infinity mirror display effect when cover 6 is in a closed or nearly closed position against stationary base member 4. In addition, FIG. 7 shows a vertically extending mounting strip 70 on the wall of stationary base member 4 behind display object 24, with evenly spaced-apart peg holes 68 therein for adjustable positioning of elevated movable support members 84 having complementary protrusions 88, as shown in FIG. 8, for the optional support of additional display objects 24 between stationary base member 4 and cover 6. Variations of the sixth preferred embodiment shown in FIG. 7, although not independently illustrated and not limited thereto, could include two or more mounting strips 70 positioned on the wall of stationary base member 4 behind display object 24; one or more mounting strips 70 also on the opposed hidden wall of stationary base member 4 positioned remotely from the wall of stationary base member 4 shown in FIG. 7; additional partially reflective mirrors 8 replacing one or more of the enclosed sides of stationary base member 4; a partially reflective mirror 8 replacing totally reflective mirror 10 with a central cutout in the rear surface of stationary base member 4 for viewing an infinity mirror display effect of display object 24 from the rear of sixth embodiment 64; and one or more movable support members 40 attached to partially reflective mirror 8 by suction cup means 60 and/or bonding/adhesive means 62 in addition to the mounting of at least one elevated movable support member 84 via peg holes 68.

FIG. 8 shows a seventh preferred embodiment 72 of the present invention having a housing with a box-like stationary base member 4 and a totally reflective mirror 10 attached to its rear inside surface, a substantially planar cover comprising a frameless partially reflective mirror 8 attached to one side of stationary base member 4 with an elongated hinge 12. It is considered to be within the scope of seventh preferred embodiment 72 for partially reflective mirror 8 to be attached by hinge 12 to any front perimeter edge of stationary base member 4, including the top and bottom perimeter edges wherein partially reflective mirror 8 would move vertically between open and closed positions. FIG. 8 also shows a two-part closure means, comprising first magnet **30*a* and second magnet 30*b*, between partially reflective mirror 8 and stationary base member 4 in a position remote from hinge 12 for securely positioning the cover against the stationary base member when partially reflective mirror 8 is in its fully closed position. Although the type of closure means employed is not critical, nor is the number of closure devices used, it is considered to be within the scope of the present invention for the two-part closure means to comprise any type of easily opening means of securing partially reflective mirror 8 against stationary base member 4. FIG. 8 shows the two-part closure means between partially reflective mirror 8 and stationary base member 4 comprising first magnet 30*a* attached to the freely moving inside perimeter edge of partially reflective mirror 8, in a position remote from hinge 12, and second magnet 30*b* attached to the stationary base member 4 in a cooperative position relative to first magnet 30*a*. FIG. 8 also shows miniature lights 18 secured to the top and side perimeter edges of totally reflective mirror 10, with one reflected image 20 of miniature lights 18 in totally reflective mirror 10 since partially reflective mirror 8 remains in an open position and unavailable for viewing any infinity mirror display effects rearwardly from miniature lights 18 or display objects 24. For clarity of illustration, reflected images 20 of display objects 24 and optional U-shaped mounting brackets 82 have been omitted from FIG. 8. Three display objects 24 are shown in FIG. 8, as well as two opposed sets of evenly spaced-apart vertically extending peg holes 68 formed directly in the sides of stationary base member 4. As an alternative to the formation of peg holes 68 directly within the walls of stationary base member 4, mounting strips 70 could be used to provide the needed peg holes 68 for adjustable elevated mounting of movable support members 84 at different heights within stationary base member 4. The size, number, and spacing of peg holes 68 are not critical, nor is the number of mounting strips 70 used. One of the display objects 24 shown in FIG. 8 is positioned a movable support member 40 placed directly upon the bottom interior surface 16 of stationary base member 4, with a second display object 24 being positioned upon an elevated movable support member 84 attached to two peg holes 68 on one side of stationary base member 4, and a third display object 24 being positioned upon an elevated movable support member 84 having protrusions 88 and ready for connection to peg holes 68 on the opposed side of stationary base member 4. The number of peg holes 68 used for attachment of each elevated movable support member 84 is not critical. Also, the number of elevated movable support members 84 used would depend upon the type of infinity mirror display effect desired and the size of stationary base member 4**.

Figure 10:
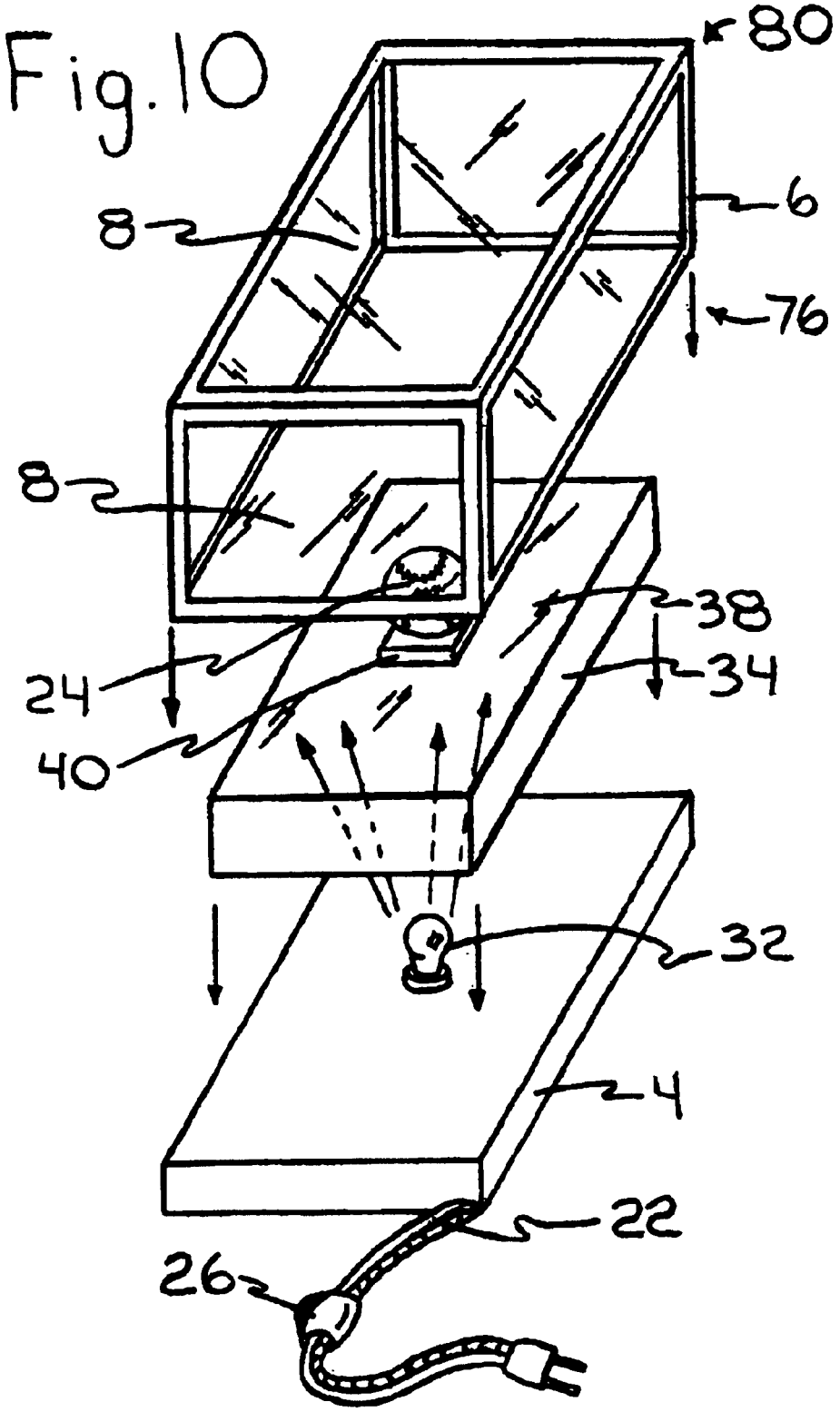
FIG. 10 is a front perspective view of a ninth preferred embodiment of the present invention having a rectangular housing with a substantially planar platform-like stationary base member and a light source attached through the upper surface of the stationary base member, a display support having a transparent or translucent top surface poised above the stationary base member, a display object being supported by a movable support member centrally atop the transparent or translucent top surface of the display support, and a box-like cover that is vertically lifted from the stationary base member to give access to the interior space defined by the stationary base member and the cover, the cover being poised over the stationary base member in an open position allowing display object exchange, the cover comprising adjoining partially reflective mirrors each supported by a frame.

FIG. 9 shows an eighth preferred embodiment 74 of the present invention having a hexagon-shaped housing with a substantially planar platform-like stationary base member 4 and a display support 34 with a transparent or translucent upper surface 38 positioned above stationary base member 4. FIG. 9 also shows eighth preferred embodiment 74 having a display object 24 being maintained in its designated display poition by a hexagon-shaped movable support member 78 centrally upon upper surface 38. Miniature lights 18 are positioned under the perimeter of upper surface 38 and secured thereto by six U-shaped mounting brackets 82. The number of U-shaped mounting brackets 82 used is not critical, however it must be sufficient to maintain miniature lights 18 close to upper surface 38 to provide adequate illumination for display object 24 and creation of a pleasing infinity display effect. In the alternative, a light source 32, such as is shown in FIG. 10, could be used to illuminate display object 24. FIG. 9 also shows a box-like cover 76 poised over display object 24 and display support 34, that can be vertically lifted from stationary base member 4 to give access to the interior space defined by stationary base member 4 and cover 76 for the exchange of display object 24. In FIG. 9 cover 76 is shown comprising adjoining frameless partially reflective mirrors 8. As a result, when eighth preferred embodiment 74 is table mounted, the infinity mirror display effect created with display object 24 can be viewed from a fully 360°. FIG. 9 also shows electrical cord 22 extending from the lower back surface of stationary base member 4 and on-off switch 26 in its preferred location close to stationary base member 4. For illustrative purposes, electrical cord 22 is shown in a shortened condition. Although not shown, it is contemplated in eighth preferred embodiment 74 for display objects 24 to be positioned for viewing upon elevated movable support members 84 secured by pegs holes 68 in mounting strips 70, or in the alternative upon movable support members 40 attached to the interior surfaces of one or more partially reflective mirrors 8 in cover 76 at differing heights by adhesive/bonding agents 62, as well as movable support members 40 secured directly to the interior surfaces of one or more partially reflective mirror to in cover 76 by suction cups 60 or adhesive/bonding agents 62, and suspension from filamentous materials 54 attached to anchoring devices 52 that are directly connected to the interior surface of one or more partially reflective mirrors in cover 76. Although box-like cover 76, display support 34, and platform-like stationary base member 4 are shown in FIG. 9 to have hexagonal configurations, the eight preferred embodiment is not limited to hexagon-shaped configurations, and it is also contemplated for cover 76, display support 34, and stationary base member 4 to have other angular configurations, such as but not limited to octagonal, trapezoidal, and square. Also, FIG. 9 shows stationary base member 4 extending beyond display support 34 so that when cover 76 is placed in its closed position, cover 76 is positioned against stationary base member 4 and does not come in contact with the table, counter, or floor surface (not shown) positioned beneath stationary base member 4.

FIG. 10 shows a ninth preferred embodiment 84 of the present invention having a rectangular housing with a substantially planar platform-like stationary base member 4 and a light source 32 attached through the upper surface of stationary base member 4. FIG. 10 also shows ninth preferred embodiment 84 having a display support 34 with a transparent or translucent upper surface 38 poised above stationary base member 4, a display object 24 being retained in a fixed display position by a movable support member 40 centrally upon upper surface 38, and a box-like cover 76 that is vertically lifted from stationary base member 4 to give access to the interior space defined by stationary base member 4 and cover 76. In FIG. 10 cover 76 is poised over stationary base member 4 in an open position allowing for rapid exchange of display object 24. Also, the cover 76 shown in FIG. 10 comprises adjoining partially reflective mirrors 8 each supported by a frame and appearing like the cover 6 shown in FIGS. 1–3 and FIG. 6. FIG. 10 also shows electrical cord 22 extending from the lower back surface of stationary base member 4 and on-off switch 26 in its preferred location close to stationary base member 4. For illustrative purposes, electrical cord 22 is shown in a shortened condition. In FIG. 10, if stationary base member 4 is not configured to extend beyond display support 34, when cover 76 is placed in its closed position against stationary base member 4, stationary base member 4 would be positioned within cover 76 and cover 6 would come in contact with the table, counter, or floor surface (not shown) positioned beneath stationary base member 4. In such a position, although not shown, cover 76 would have a small aperture or cut-out for electrical cord 22. Display support 34 could be freely separable from stationary base member 4, or permanently secured thereto. When display support 34 is permanently secured to stationary base member 4, light source 32 would be exchanged through the bottom surface of stationary base member 4. Although it is contemplated for cover 76, display support 34, stationary base member 4, movable support members 40 to have any type of angular configuration, angular configurations are preferred since arcuate configurations do not always provide as pleasing an infinity mirror display effect. Also, no handle is contemplated for cover 76 in the ninth preferred embodiment 84 to assist in lifting it away from stationary base member 4, as handles often detract from the infinity mirror display effect created by display objects 24 positioned within the interior space defined between cover 76 and stationary base member 4

To manufacture the present invention, one would first determine whether the present invention is to be used for wall-mounted or table-mounted display. If wall-mounted display is selected, then stationary base member 4 would be made into a box-like configuration, and cover 6 for most purposes would be substantially planar in configuration. If table-mounted display is selected, then stationary base member 4 would be made into a substantially planar platform-like configuration, and cover 76 would have a corresponding box-like configuration. It is also contemplated for cover 6 and stationary base member 4 to both have complementary three-dimensional configurations, such as when cover 6 would have two or three aligned partially reflective mirrors 8, and the complementing stationary base member 4 would respectively have top, bottom, and back surfaces with only one side surface, or a U-shaped configuration with only top, bottom, and back surfaces. If substantially planar cover 6 and box-like stationary base member 4, or a cover 6 and complementing stationary base member 4 each having a three-dimensional configuration are selected for use, one or more easily opening closure means, such as but not limited to hinge 12 in combination with first magnet 30*a* and second magnet 30*b*, would be connected between stationary base member 4 and cover 6 to secure cover 6 against stationary base member 4 when cover 6 is in its fully closed position. Locking means, such as keyed fastener 44, can also be used when limited access to display objects 24 positioned within the interior space defined by stationary base member 4 and cover 6 is desired. Thereafter, the type of illumination must be selected to create a pleasing infinity mirror display effect with the display object or objects 24. Although not limited thereto, the source of illumination used can be individual incandescent bulbs 32, incandescent miniature lights 18 housed within a flexible plastic tubing, light emitting diodes, electroluminescent lights, or neon lighting. Preferably, for a more pleasing infinity mirror display effect, the illumination source used is placed within box-like stationary base member 4 in a position remote from partially reflective mirror or mirrors 8, or positioned between stationary base member 4 and a display support 34 having a transparent or translucent upper surface 38. In the alternative when illumination sources are attached to box-like cover 76, the high number of multiple reflected images 42 created usually interferes with the infinity mirror display effect desired for the display objects 24. Once the illumination source is secured within the interior space defined by stationary base member 4 and cover 6 or 76, an opening is formed in stationary base member 4, and also in cover 6 or 76 when needed, for electrical cord 22. Although use of a remote power supply (not shown) is preferred, it is also considered to be within the scope of the present invention for a direct current power source (not shown) to be used and positioned within the interior space defined by stationary base member 4 and cover 6 or 76. Preferably, any direct current power source used would be out of the direct line of sight of an observer, and/or hidden beneath a display support 34. Should the use of a suspended display object 56 be desired, one or more anchoring devices 52 would be attached to the inside top surface of box-like stationary base member 4 or box-like cover 76. Also, a collection of display objects 24 and suspended display objects 56 must be selected for infinity mirror display effect. Filamentous material 54 is secured around each suspended display object 56 in a manner so as not to permanently alter or modify it. Also, when display objects 24 unable to remain unassisted in a fixed position have been selected, devices to retain display objects 24 in a fixed display position are employed, such as one or more movable support members 40 being optionally positioned upon inside bottom surface 16 or upon transparent or translucent upper surface 38, one or more movable support members 40 being optionally secured by suction cups 60 or adhesive/bonding agents 62 to one or more partially reflective mirrors 8, a mounting strip 70 having spaced-apart peg holes 68 being optionally attached in a vertically extending manner to stationary base member 4 or to cover 76 and the protrusions 88 on one or more elevated support members 84 being secured within peg holes 68 at a height desired, or spaced-apart peg holes 68 being optionally formed in a vertically extending manner into a side wall of stationary base member 4 and the protrusions 88 on one or more elevated support members 84 are secured within peg holes 68 at a desired height.

To use the present invention, one would select a single display object 24 and/or suspended display object 56, or in the alternative several display objects 24 and/or suspended display objects 56 for initial display. Since it is contemplated that the present invention would routinely be stored or used with cover 6 or 76 in its fully closed position against stationary base member 4, cover 6 or 76 would then be forwardly rotated, vertically raised, or lifted away from stationary base member 4 into a fully opened position or an opened position having sufficient access to the interior space defined by cover 6 or 76 and stationary base member 4 to achieve display object 24 or suspended display object 56 exchange. With cover 6 or 76 in its opened position, one or more display objects 24 would be directly placed upon inside bottom surface 16, upon one or more movable support members 40, upon one or more hexagon-shaped support members 78, or upon one or more elevated support members 84. Also, one or more suspended display objects 56 would be optionally connected by an attached piece of filamentous material 54 to one or more anchoring devices 52. Once the originally selected display objects 24 and suspended display objects 56 are in their desired positions within the interior space defined by stationary base member 4 and cover 6 or 76, cover 6 or 76 would be rotated, vertically lowered, or moved into contact with stationary base member 4 to place cover 6 or 76 into its fully closed position. Keyed fastener 44, or other locking closure means (not shown) would be engaged to temporarily prevent separation of cover 6 from stationary base member 4 when unlimited access to the originally selected display objects 24 and suspended display objects 56 is desired. Electrical cord 22 would then be connected to a power source (not shown) and on-off switch would be engaged to cause illumination of light source 32 or miniature lights 18 and create a pleasing infinity mirror display effect with all of the originally selected display objects 24 and suspended display objects 56. When a different infinity mirror display effect is desired, or when new display objects 24 or suspended display objects 56 are purchased or received, the new display object or objects 24, or suspended display object or objects 56 can be added to the original display objects 24 or suspended display objects 56 simply by separating the easily opened cover 6 or 76 from stationary base member 4, making the addition, and once again rapidly and promptly replacing cover 6 or 76 in its fully closed position against stationary base member 4. Should one of the original display objects 24 or suspended display objects 56 be targeted for exchange or removal, the same separation and reconnections steps used for adding a new display object 24 or suspended display object 56 can be employed. Before addition, removal, or exchange of display objects 24 or suspended display objects 56, there would be no need to re-engage on-off switch 26 to turn off the illumination source. However, where indicated by the size differences between the original and new display objects 24 or suspended display objects 56, suction cups 60 could be disengaged and protrusions 88 removed from peg holes 68 to reposition movable support members 40 and/or elevated support members 84 to accommodate the size and configuration of the newly introduced display objects 24 or suspended display objects 56. When the infinity mirror display effect is no longer desired, there would be no need to remove display objects 24 or suspended display objects 56 from the interior space defined between stationary base member 4 and cover 6 or 76, unless the user had a desire to do so. It would only be required for on-off switch 26 to be re-engaged so as to turn off the source of illumination, such as light source 32 or miniature lights 18.

What is claimed is:

1. An infinity mirror display apparatus for enhanced exhibition of different groupings of independently prized collectible objects without injury to and permanent modification thereto, which allows for frequent and prompt replacement of currently exhibited collectible objects by newly selected collectible objects so as to maintain within said apparatus a selection of collectible objects that continually updates the artistic and aesthetic effect it exhibits to maintain a fresh and interesting effect for the operator and other viewers, said apparatus comprising:

a housing having a stationary base member and a cover which together define an enclosed interior space, said cover being easily movable between a closed position against said stationary base member and a plurality of opened positions wherein rapid access to said interior space is provided without moving said base member from its operational position;

at least two opposed mirrors positioned adjacent to said interior space with said mirrors being at a spaced-apart distance from one another and at least one of said mirrors being a partially reflective mirror;

a plurality of collectible objects each smaller than said interior space, at least one of said collectible objects being initially operator selected and positioned between said mirrors;

support means adapted for secure positioning of at least one of said collectible objects within said interior space without permanent modification to said collectible object and without restriction on rapid replacement of said securely positioned and currently exhibited collectible object by a new one of said collectible objects selected according to operator impulse;

at least one light source positioned within said interior space and configured for sufficient illumination of each said selected collectible object positioned between said mirrors to create multiple closely spaced-apart reflected images rearwardly therefrom and make an infinity mirror effect; and electrical connection means adapted for connecting each said light source to a source of power so that when said selected collectible objects and said support means are within said interior space in operational positions and electrical power is provided to each said light source, exhibition of each said collectible object within said interior space is enhanced by an infinity mirror effect to observers looking at said collectible object through each said partially reflective mirror and also when a new appearance is desired for said apparatus an operator can promptly make additions and removals of said collectible objects to and from said interior space without having to substantially dismantle said apparatus, move said base member from its operational position, or disturb any of said collectible objects already positioned within said interior space.

2. The apparatus of claim 1 further comprising a control means adapted for interruption of electrical power to each said light source, said control means being positioned externally from said base member and said cover, as well as near to said base member for easy access by an operator without movement of said cover into one of said opened positions.

3. The apparatus of claim 1 further comprising fastening means adapted for securing said cover against said base member when said cover is in said closed position and wherein said fastening means is selected from a group consisting of hinges, magnetic closure means, keyed locking means, and snap-fit types of closure means.

4. The apparatus of claim 1 wherein said cover is selected from a group consisting of totally detachable covers, partially detachable covers, substantially planar covers, and covers with handles adapted for ease in cover manipulation between said closed position and said opened positions.

5. The apparatus of claim 1 wherein said stationary base member further comprises a plurality of side surfaces, and wherein said housings are selected from a group consisting of wall-mounted housings adapted for enhanced exhibition of each said collectible object positioned therein with an infinity mirror effect viewed through said cover and at least one of said side surfaces, and table-mounted housings adapted for exhibition of each said collectible object positioned therein with an infinity mirror effect viewed through said cover and at least one of said side surfaces.

6. The apparatus of claim 1 wherein said support means is selected from a group consisting of transparent lower supports, translucent lower supports, opaque lower supports having at least one aperture therethrough, supports attachable to glass through suction cup means, means for suspending display at least one of said collectible objects within said interior space, and support means comprising interlocking protrusions and peg holes.

7. The apparatus of claim 1 wherein each said light source is selected from a group consisting of incandescent bulbs, multiple miniature incandescent light bulbs encased within elongated flexible plastic tubing, neon lights, light emitting diode lighting, and electroluminescent lights.

8. The apparatus of claim 1 wherein said stationary base member has opposed grooves therein adjacent to said interior space and said cover has opposed perimeter edges, and wherein said opposed perimeter edges of said cover are slidably positioned within said grooves for movement between said closed position and said opened positions.

9. A method of making an infinity mirror display apparatus for enhanced exhibition of objects treasured apart from their use with said apparatus, including objects that are part of a collection, which allows prompt exchange of one collectible object for another, as well as exhibition of objects without a need for any permanent modification thereto, said method comprising the steps of:

providing a housing having an interior spaced defined by a stationary base member and an easily separable cover, at least one totally reflective mirror, a plurality of partially reflective mirrors, a plurality of collectible objects each smaller than said interior space, at least one light source, electrical connection means, and a power source;

attaching a first one of said partially reflective mirrors to said cover in a position where said partially reflective mirror is adjacent to said interior space and also so that an illuminated object positioned behind said partially reflective mirror can be viewed by an observer looking through said partially reflective mirror;

positioning a remaining one of said mirrors adjacent to said interior space so that a reflected image from an illuminated object positioned behind said partially reflective mirror can be viewed by an observer looking through said partially reflective mirror;

positioning selected ones of said collectible objects within said interior space and between the ones of said mirrors positioned adjacent said interior space;

positioning each said light source within said interior space in a position remote from each said partially reflective mirror used and also in a position to provide sufficient illumination for at least one of said collectible objects so that multiple reflected images of all of said collectible objects selected for positioning within said interior space can be seen through said partially reflective mirrors;

optionally forming an opening within said stationary base member and said cover for extension therethrough of said electrical connection means; and using said electrical connection means to connect each said light source to said power source so that when each said light source is activated, each of said selected collectible objects viewed through one of said partially reflective mirrors positioned adjacent to said interior space is enhanced by said multiple reflected images creating an infinity mirror effect.

10. The method of claim 9 further comprising the providing of a means of closure between said stationary base member and said wherein said means of closure is selected from a group consisting of hinges, easily releasable closure means, promptly releasable closure means, snap-fit types of closure means, magnets, and locking closure means.

11. The method of claim 9 further comprising a step of providing a control means adapted for interruption of electrical power to each said light source, and a step of positioning said control means externally from said base member and said cover in a location near to said base member for easy access by an operator without movement of said cover into one of said opened positions.

12. The method of claim 9 further comprising display object support means and wherein said display object support means is selected from a group consisting of display supports having a transparent upper surface, display supports having a translucent upper surface, movable display support members, movable display support members secured in place by at least one suction cup, movable display support members secured in place by adhesive means, and movable display support members secured in place by bonding agent means.

13. The method of claim 9 further comprising the steps of providing a plurality of vertically extending spaced-apart peg holes and providing a plurality of elevated support members each having at least one protrusion thereon configured for engaging one of said peg holes.

14. The method of claim 13 wherein said step of providing a plurality of vertically extending spaced-apart peg holes is achieved through steps in a group consisting of the step of providing of a plurality of mounting strips having peg holes, connecting selected ones of said mounting strips in a vertical orientation to said stationary base member so that each of said mounting strips so mounted is positioned within said interior space, connecting selected ones of said mounting strips in a vertical orientation to said cover so that each of said mounting strips so mounted is positioned within said interior space, forming a plurality of peg holes which are spaced apart from one another directly within said stationary base member so that a device mating with any of said peg holes becomes positioned within said interior space, and forming a plurality of peg holes which are uniformly spaced apart from one another directly within said stationary base member so that a device mating with any of said peg holes becomes positioned within said interior space.

15. The method of claim 9 further comprising the steps of providing of a plurality of anchoring devices, providing a quantity of filamentous material, attaching a selected number of said anchoring devices to said stationary base member, securing at least a portion of said filamentous material to at least one of said collectible objects to create suspendable display objects, and rapidly connecting said filamentous material to at least one of said anchoring devices so as to freely hang each said suspendable display object within said interior space.

16. The method of claim 9 wherein said light source is selected from a group consisting of individual incandescent bulbs, incandescent miniature lights housed within a flexible plastic tubing, light emitting diodes, electroluminescent lights, and neon lighting.

17. The method of claim 9 wherein said stationary base member has opposed grooves therein adjacent to said interior space and said cover has opposed perimeter edges, and wherein said opposed perimeter edges of said cover are slidably positioned within said grooves for movement between said closed position and said opened positions.

18. An infinity mirror display apparatus for enhanced exhibition of a plurality of independently prized collectible objects without injury to and permanent alteration thereof, which allows for repeated and prompt replacement of currently exhibited collectible objects by new collectible objects selected according to operator impulse for maintaining within said apparatus a selection of collectible objects that remains fresh and interesting to the operator, and other viewers, said apparatus comprising:

a housing having a stationary base member and a cover which together define an enclosed interior space, said cover being easily movable between a closed position against said stationary base member and a plurality of opened positions wherein rapid access to said interior space is provided without moving said base member from its operational position;

fastening means adapted for securing said cover against said base member when said cover is in said closed position, and wherein said fastening means is selected from a group consisting of hinges, magnetic closure means, keyed locking means, and snap-fit types of closure means;

at least two opposed mirrors positioned adjacent to said interior space with said mirrors being at a spaced-apart distance from one another and at least one of said mirrors being a partially reflective mirror;

a plurality of collectible objects each smaller than said interior space, at least one of said collectible objects being initially operator selected and positioned between said mirrors; support means adapted for secure positioning of at least one of said collectible objects within said interior space without permanent alteration and modification to said collectible objects and without restriction on prompt replacement of said securely positioned and currently exhibited collectible object by a newly selected one of said collectible objects according to operator impulse, and wherein said support means is selected from a group consisting of transparent lower supports, translucent lower supports, opaque lower supports having at least one aperture therethrough, supports attachable to glass through suction cup means, means for suspending display of at least one of said collectible objects within said interior space, and support means comprising interlocking protrusions and peg holes at least one light source positioned within said interior space and configured for is sufficient illumination of each said selected collectible object positioned between said mirrors to create multiple closely spaced-apart reflected images rearwardly therefrom and make an infinity mirror effect, and wherein each said light source is selected from a group consisting of incandescent bulbs, multiple miniature incandescent light bulbs encased within elongated flexible plastic tubing, neon lights, light emitting diode lighting, and electroluminescent lights; and electrical connection means adapted for connecting each said light source to a source of power so that when said selected collectible objects and said support means are within said interior space in operational positions and electrical power is provided to each said light source, exhibition of each said collectible object within said interior space is enhanced by an infinity mirror effect to observers looking at said collectible object through each said partially reflective mirror and also when a new appearance is desired for said apparatus an operator can promptly make additions and removals of said collectible objects to and from said interior space without having to substantially dismantle said apparatus, move said base member from its operational position, or disturb any of said collectible objects already positioned within said interior space.

19. The apparatus of claim 18 wherein said stationary base member further comprises a plurality of side surfaces, and wherein said housings are selected from a group consisting of wall-mounted housings adapted for enhanced exhibition of each said collectible object positioned therein with an infinity mirror effect viewed through said cover and at least one of said side surfaces, and table-mounted housings adapted for exhibition of each said collectible object positioned therein with an infinity mirror effect viewed through said cover and at least one of said side surfaces.

20. The apparatus of claim 18 wherein said stationary base member has opposed grooves therein adjacent to said interior space and said cover has opposed perimeter edges, and wherein said opposed perimeter edges of said cover are slidably positioned within said grooves for movement between said closed position and said opened positions.

* * * * *